United States Patent [19]

Gusev et al.

[11] 4,230,425

[45] Oct. 28, 1980

[54] METHOD AND INSTALLATION FOR PRODUCING CAST-IN-SITU PILES

[76] Inventors: Vladimir A. Gusev, Yaroslavov val. 15a, kv. 5; Jury I. Oprisko, ulitsa Bogomoltsa, 7/14, kv. 18, both of Kiev; Alexandr P. Sorochinsky, ulitsa Vokzalnaya, 19, kv . 49, poselok Glevakha, Kievskoi oblasti, all of U.S.S.R.

[21] Appl. No.: 21,490

[22] Filed: Mar. 19, 1979

[51] Int. Cl.[3] ..... E02D 5/38; E02D 7/18; E02D 7/26; E02D 7/28

[52] U.S. Cl. ..... 405/239; 405/237; 405/240

[58] Field of Search ..... 405/233, 234, 235, 237, 405/239, 240, 241, 243; 175/16; 166/248, 299, 63, 65 R

[56] References Cited

U.S. PATENT DOCUMENTS

| | | | |
|---|---|---|---|
| 1,106,606 | 8/1914 | Wilhelmi | 405/234 |
| 1,904,079 | 4/1933 | Powell | 405/240 |
| 2,146,645 | 2/1939 | Newman | 405/239 |
| 3,060,694 | 10/1962 | Holmes | 405/239 |
| 3,130,552 | 4/1964 | Bodine, Jr. | 405/240 X |
| 3,191,390 | 6/1965 | Schutte | 405/239 X |
| 3,270,511 | 9/1966 | Colle | 405/240 X |
| 3,500,942 | 3/1970 | Smith, Jr. | 175/16 |
| 3,708,022 | 1/1973 | Woodruff | 175/16 |
| 3,779,025 | 12/1973 | Godley et al. | 405/233 X |
| 3,898,848 | 8/1975 | Wyant | 405/233 |

FOREIGN PATENT DOCUMENTS

| | | | |
|---|---|---|---|
| 86630 | 12/1958 | Denmark | 405/233 |
| 2217485 | 8/1973 | Fed. Rep. of Germany | 405/233 |
| 426661 | 6/1967 | Switzerland | 405/234 |
| 253666 | 2/1970 | U.S.S.R. | 405/233 |
| 543273 | 11/1978 | U.S.S.R. | 175/16 |
| 599581 | 11/1978 | U.S.S.R. | 175/16 |

*Primary Examiner*—Stephen J. Novosad

*Attorney, Agent, or Firm*—Lackenbach, Lilling & Siegel

[57] ABSTRACT

According to the invention, a casing pipe is set on the ground and filled with a fluid, whereupon electric pulses are passed through the fluid to produce a series of electric discharges. The casing pipe is driven into the ground due to the resultant electrohydraulic effect. While the casing pipe is being pulled from the ground, it is filled with concrete mix which is compacted by passing electric pulses therethrough to produce electric discharges. The installation for effecting this method comprises a pile puller, a pile driver and a concrete feeder, all connected to the casing pipe. The pile driver incorporates a fluid feed system communicating with the casing pipe, and a pulse device with electrodes installed at the lower portion of the casing pipe, which is intended to produce electric discharges in the fluid fed into the casing pipe by the fluid feed system.

48 Claims, 30 Drawing Figures

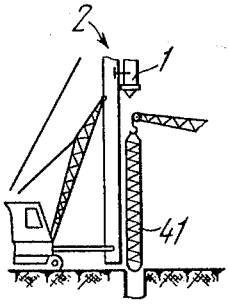
FIG. 17a
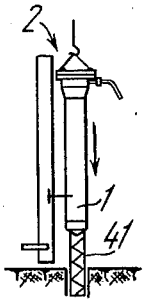
FIG. 17b
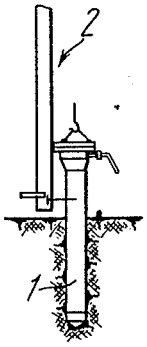
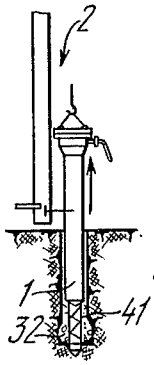
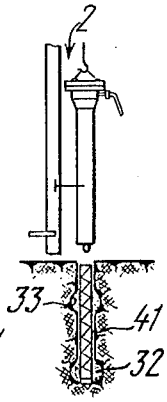
FIG. 17c FIG. 17d FIG. 17e
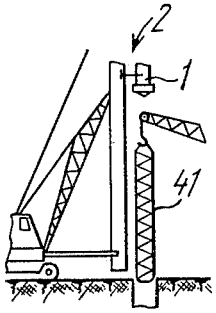
FIG. 18a
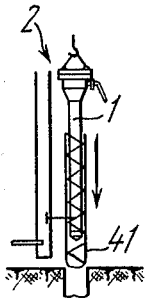
FIG. 18b
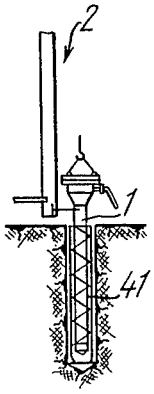
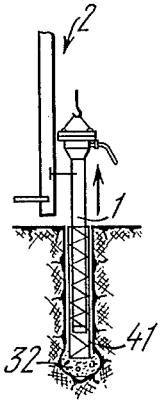
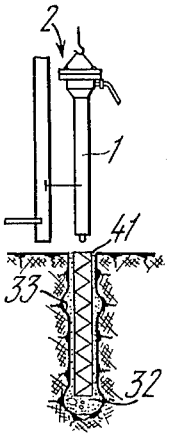
FIG. 18c FIG. 18d FIG. 18e

METHOD AND INSTALLATION FOR PRODUCING CAST-IN-SITU PILES

BACKGROUND OF THE INVENTION 1. Field of the Invention

The present invention relates to civil engineering and, more particularly, to methods and equipment for making filling piles. The invention is useful in laying foundations of concrete and reinforced concrete piles for apartment and industrial buildings, hydraulic structures and other facilities. 2. Description of the Prior Art There is known a method for producing filling piles, wherein a hole is drilled in the ground to extend outside the drilled rock. A casing pipe, which serves to prevent crumbling of the hole walls, is placed in the hole and filled with a concrete mix. The concrete mix is compacted, and the casing pipe is pulled out (cf. accepted Federal Republic of Germany Application No 2,217,485, Cl. 84c, 5/38). The installation for effecting this method (ibid.) comprises a drilling machine, a concrete mix feeder, and a casing pipe provided with a ring means for compressing the concrete mix.

An important limitation of the above method is the necessity of drilling a hole. Another disadvantage of this method resides in the impossibility of making reinforced concrete piles. The installation for carrying out this method is too big and complicated.

There is known a more productive method of making filling piles, wherein a casing pipe is set on the ground and driven to a prescribed depth. Concrete mix is then fed into the casing pipe, and at the same time the latter is gradually pulled out and the mix is compacted (cf. USSR Inventor's Certificate No. 253,666, IPC E 02 d 5/40).

The installation for effecting the latter method (ibid) comprises a casing pipe coupled to a pile puller intended to set the pipe on the ground, support it and pull it from the ground, a pile driver intended to drive the casing pipe into the ground, and a concrete mix feeder intended to feed the concrete mix into the casing pipe as the latter is being pulled from the ground.

The pile driver comprises a vibrator mounted on the casing pipe and coupled to the pile puller. The vibrator makes the casing pipe vibrate along its axis, thereby driving the casing pipe down to a prescribed depth.

Fitted over the lower end of the casing pipe is a detachable tubular cap. Inside the cap there are radially extending ribs and a ring diaphragm.

As the casing pipe is pulled out, the radial ribs act on the concrete mix and compact it. The extraction of the casing pipe is periodically discontinued, and the pipe is dropped so that the ring diaphragm strikes the concrete mix and compacts it to a desired density.

In some cases the impact of the ring diaphragm drives the mix out of the hole, whereby the pile is made thicker and its carrying capacity is improved.

However, the foregoing method and equipment cannot ensure a high production rate, because the process of driving the casing pipe into the ground is relatively slow, and because the whole operation is further slowed down by the necessity to discontinue the extraction of the pile in order to compact the concrete mix.

Another disadvantage is that the ring diaphragm cannot compact the mix to a required degree, which accounts for a limited carrying capacity of the piles.

Though the method under review makes it possible to make piles with some portions thicker than the rest of the pile, it can be applied to soft soils only, because the impact capacity of the ring diaphragm is insufficient to overcome the resistance of hard ground. In addition, it is impossible to predict the size and shape of a broader portion of a pile to any reasonable degree of certainty.

Furthermore, the process under review is inapplicable to making piles of reinforced concrete, because the ribs and ring diaphragm considerably reduce the section of the internal channel of the casing pipe, which renders it difficult to squeeze a reinforcing cage through this channel into the hole.

Of course, a reinforcing cage could be fitted over the casing pipe, but the mechanical action by the vibrator transmitted to the ground through the casing pipe is insufficient to make a cavity around the casing pipe wide enough to accommodate the reinforcing cage.

SUMMARY OF THE INVENTION

It is the principal object of the present invention to provide a method and installation for producing cast-in-situ piles, which ensures a high production rate.

It is another object of the invention to provide a method and installation for producing cast-in-situ piles, which increase the compaction of concrete mix and thus improves the carrying capacity of piles.

It is still another object of the invention to provide a method and installation for producing cast-in-situ piles, which is capable of producing piles of variable sections in different types of soils, including very stiff soils.

It is a further object of the invention to provide a method for producing cast-in-situ piles, which produces piles both of concrete and of reinforced concrete.

The foregoing and other objects of the present invention are attained by providing a method for producing cast-in-situ piles, comprising setting a casing pipe on the ground, driving the casing pipe down to a desired depth, and then filling the casing pipe with concrete mix as the casing pipe is pulled from the ground and the concrete mix is, compacted in accordance with the invention, in order to drive the casing pipe into the ground, the former is filled with a fluid, and electric pulses are passed through the fluid to produce electric discharges having paremeters such that permit hydraulic shock waves to be formed at the lower portion of the casing pipe, acting on the ground and casing pipe, and the concrete mix is compacted by using the same technique to produce electric discharges therein.

The strong impact of the hydraulic shock waves, whereof the source is found right in the casing pipe, accounts for a continuous formation of a cavity under the lower end of the casing pipe, wherefore the casing pipe is rapidly lowered under gravity.

The downward motion of the casing pipe is accelerated by its vibration due to the action of the hydraulic shock waves on the casing pipe. Hydraulic shock waves provide for a much better compaction of the concrete mix than a mechanical vibrator, which, in turn, accounts for an improved structure of the pile material.

The parameter which permits hydraulic shock waves to be formed at the lower portion of the casing pipe, is the amount of energy released by electric discharges per unit of time and per unit of ground area in the zone covered by the hydraulic shock waves. This amount of energy can be varied to produce piles of variable sections.

It can be varied, for example, by changing the electric pulse repetition frequency, for the amount of energy carried by a single pulse, or the rate at which the casing pipe is pulled from the ground; each of the above parameters may be varied separately and in any combination with the other parameters.

The electric pulse repetition frequency may be varied within the range of 0.1 to 10 Hz; the amount of energy carried by a single pulse is variable within the range of 0.1 to 300 kj; and the rate whereat the casing pipe is pulled from the ground may be varied from 0.1 to 5 m/min.

If the foregoing parameters are maintained within the prescribed limits, the present metod for producing cast-in-situ piles can be economically carried out with the use of a mobile installation.

In order to produce piles of reinforced concrete, it is expedient that prior to filling the casing pipe with a fluid, the casing pipe be fitted over a reinforcing cage which serves to reinforce the pile being made; the casing pipe can also be inserted into a reinforcing cage.

After the casing pipe is pulled from the ground, the concrete mix may be compacted by producing electric discharges in a grillage sheathing set in advance on the ground, whereby the overground portion of the pile is produced. This makes it possible to lay raft-type pile foundations.

It is highly desirable that the medium wherein electric discharges are produced, should possess the properties of a binder, such as water glass. As a result, the process of making a cast-in-situ pile is accompanied by impregnating the soil around it with a binder, a welcome improvement when working on loose soils or slide-hazardous slopes.

In order to raise productivity, it is advisable that the action of electric discharges be augmented by a mechanical action on the casing pipe essentially in the downward direction. Static, shock and vibration loads are all suitable for the purpose. Each of the foregoing load types may be used separately or in combination with such other types.

The foregoing and other objects of the present invention are further attained by providing an installation for carrying out the method, comprising a casing pipe coupled to a pile puller intended to set the casing pipe on the ground, support it and pull it from the ground, a pile driver intended to drive the casing pipe into the ground, and a concrete feeder intended to feed the concrete mix into the casing pipe as the latter is pulled from the ground, wherein, according to the invention, the pile driver incorporates a fluid feed system communicating with the casing pipe, and a pulse device comprising an electric pulse generator arranged in proximity to the casing pipe and electrodes mounted at the lower portion of the casing pipe and electrically connected to the electric pulse generator, so that pulses produced by the electric pulse generator cause electric discharges between the electrodes, whereby the resultant hydraulic shock waves occuring in the fluid fed into the casing pipe by the fluid feed system act on the ground to drive the casing pipe home.

Such a construction of the installation allows a casing pipe to be driven at a much faster rate as compared with conventional installations, which accounts for better productivity. The electrodes arranged at the lower portion of the casing pipe produce mechanical vibrations in the concrete mix, which accounts for better compaction.

The installation may include at least one ring electrode coaxial with the casing pipe; in the simplest case, the function of such an electrode is performed by the casing pipe itself.

According to an alternative embodiment of the invention, the electrodes are so arranged in the casing pipe that the line of action of electric discharges between the electrodes is roughly parallel to the axis of the casing pipe.

Such an arrangement of the electrodes is advantageous in that apart from the cavity under the lower butt end of the casing pipe, hydraulic shock waves also produce a cavity around that end of the casing pipe so that the latter may go down faster. In addition, it is possible to make piles of a diameter greater than that of the casing pipe, and piles of variable diameters.

Furthermore, such an arrangement of the electrodes intensifies the compaction of the concrete mix; apart from their action on the ground, hydraulic shock waves also act on the casing pipe, making it vibrate in the downward direction.

According to another preferred embodiment, all the electrodes, with the exception of the ring electrode, are constructed as rods spaced on the generatrices of a conventional body of revolution coaxial with the casing pipe.

This accounts for an equilibrium of forces developed by hydraulic shock waves and directed at the walls of the casing pipe. As a result, the casing pipe is driven strictly in the desired direction.

According to a further preferred embodiment, the electrodes are grouped into at least one pair of electrodes, with the electrodes arranged one above the other. This also helps to make the line of action of electric discharges parallel with the axis of the casing pipe.

It is desirable in this case that the lower electrode of the pair of electrodes be tapered in the downward direction. This facilitates the progress of the casing pipe and speeds up the whole pile producing process.

It is expedient that the pile driver be provided with at least one deflector installed close to the lower end of the casing pipe and serving to focus and localize the hydraulic shock waves. This ensures a fuller utilization of the energy of hydraulic shock waves to produce piles of desired shapes. It is possible, for example, to produce piles featuring thicker portions which are eccentric in relation to the pile axis.

To simplify the design, the function of the deflector can be performed by the upper surface of the lower electrode of the pair of electrodes.

It is highly advisable that the lower electrode of the pair of electrodes be movable along the axis of the casing pipe. As a result, electric discharges make the lower electrode vibrate, which further accelerates the progress of the casing pipe.

The progress of the casing pipe may be accelerated by a load mounted on the upper butt end of the casing pipe and thus providing a static loading of that pipe as it is driven into the ground.

That purpose can also be attained with the use of a vibrator mounted on the upper butt end of the casing pipe and intended to make the casing pipe vibrate as it goes down.

According to a further embodiment, the installation is provided with a hammer arranged above the upper butt end of the casing pipe and intended to periodically strike the casing pipe as it is driven into the ground. This also helps to accelerate the progress of the casing pipe.

The load, vibrator and hammer may be used separately or in any combination.

BRIEF DESCRIPTION OF THE DRAWINGS

Other objects and advantages of the present invention will become more apparent from the following detailed description of the preferred embodiments when read in conjunction with the accompanying drawings, wherein:

FIG. 17 *a, b, c, d, e* is a step-by-step representation of the process of producing a pile of reinforced concrete according to a preferred modification of the method of the invention, whereby the casing pipe is fitted over a reinforcing cage (the arrows indicate the direction of motion of the casing pipe); and FIG. 18 *a, b, c, d, e* is a step-by-step representation of the process of producing a pile of reinforced concrete according to a preferred modification of the method of the invention, whereby the casing pipe is inserted in a reinforcing cage.

DETAILED DESCRIPTION OF THE PREFERRED EMBODIMENT

According to the invention, the method for producing cast-in-situ piles is carried out with the use of an installation comprising a casing pipe 1 (FIG. 1) which is coupled to a pile puller 2 intended to set the casing pipe 1 on the ground, support it and pull it from the ground, a pile driver 3 intended to drive the casing pipe 1 into the ground, and a concrete feeder 4 intended to feed concrete mix into the casing pipe 1 as it is pulled from the ground.

Figure 1:
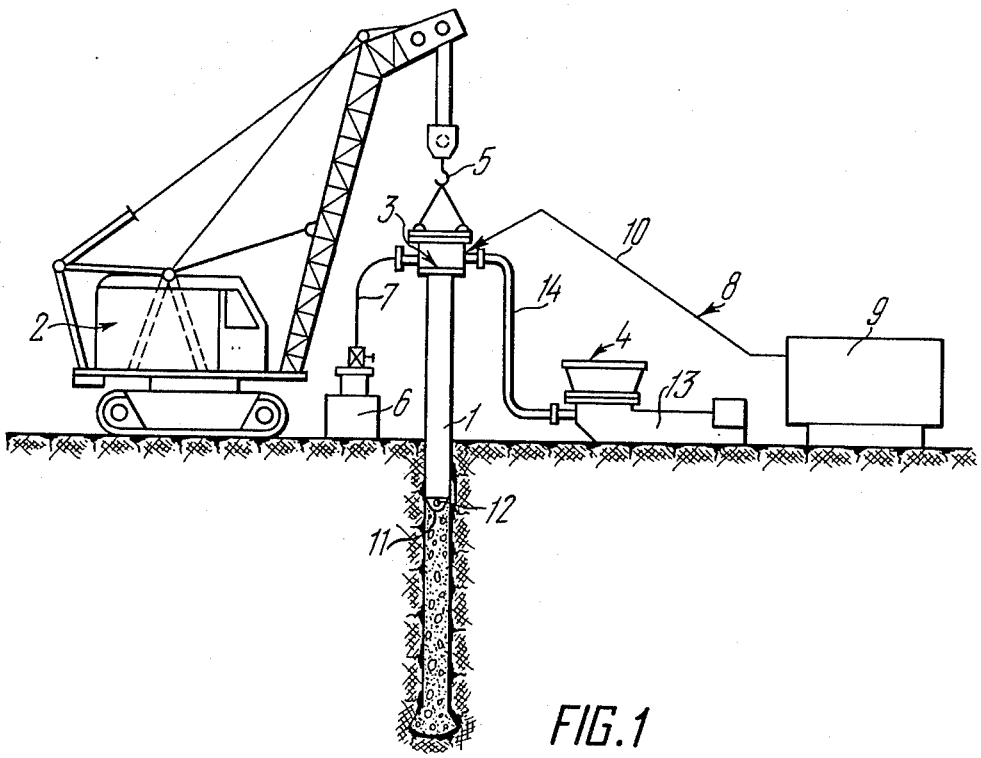
FIG. 1 is a schematic view of the installation for producing cast-in-situ piles in accordance with the invention.

The pile puller 2 is a crane, for example, a truck crane as shown in FIG. 1. The casing pipe 1 is suspended on a hook 5 of the crane. The pile puller 2 may also be a ram engine which is provided with guide means adjustable at any angle to the vertical so that it is possible to drive the casing pipe 1 at an angle to the vertical and produce raking piles. In fact, the pile puller 2 may be any lifting means capable of supporting the casing pipe 1 in a desired position and pulling it from the ground.

The pile driver 3 incorporates a fluid feed system 6 communicating with the internal cavity of the casing pipe 1 by means of a pipeline 7, and a pulse device 8 which comprises an electric pulse generator 9 set on the ground in proximity to the casing pipe 1, and electrodes 11 and 12 electrically connected by a cable 10 to the generator 9 and installed at the lower portion of the casing pipe 1, close to its lower butt end. The electrodes 11 and 12 will be described in greater detail below.

The fluid feed system 6 comprises a pump connected to a tank or a water supply line (not shown).

The voltage across the output terminals of the electric pulse generator 9 must be high enough to produce electric discharges between the electrodes 11 and 12 in a liquid medium.

The concrete feeder 4 comprises a concrete pump 13 connected through a hose 14 to the casing pipe 1. The concrete feeder may be of any other form or construction, such as, for instance, as a bucket suspended on the hook of the hoisting means above the upper end of the casing pipe 1.

The foregoing modifications of the installation for producing cast-in-situ piles in accordance with the invention differ in the design of that part of the pile driver 3 which is structurally connected to the lower portion of the casing pipe 1. Such differences stem from the specific requirements imposed on piles to be made and the conditions on the site.

Figure 2:
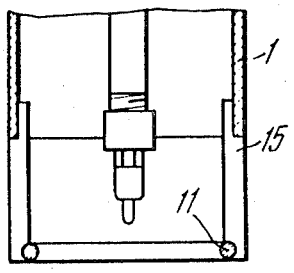
FIG. 2 is a fragmentary side elevational view of the lower portion of the casing pipe with the electrodes installed therein.

According to a simpler embodiment of the invention presented in FIG. 2, the electrode 11 is of the ring type; it is electrically connected to the negative terminal of a generator 9 (FIG. 1) and rigidly secured by means of supports 15 (FIG. 1) to the wall of the casing pipe 1. The electrode 12 is a rod electrically connected to the positive terminal of the generator 9 (FIG. 1). Both electrodes are coaxial with the casing pipe 1 (FIG. 2).

Figure 3:
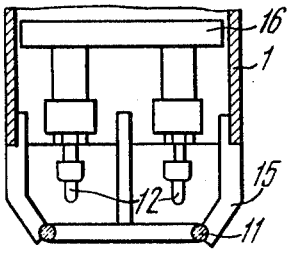
FIG. 3 is a fragmentary, side elevational view of the lower portion of the casing pipe with a negative electrode of the ring type and positive electrodes arranged above the negative electrode.
Figure 4:
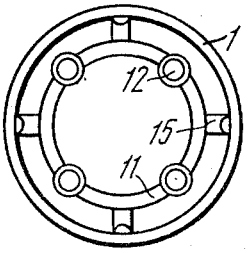
FIG. 4 is a plan view of the lower portion of the casing shown in FIG. 3, but with the electrode holder not shown.

According to other preferred embodiments of the invention, the installation features a plurality of positive electrodes 12. As shown in FIGS. 3 and 4, an electrode holder 16 is arranged above the negative ring electrode 11 and carries a number of positive electrodes 12 which are rods spaced on the generatrices of a conventional body of revolution coaxial with the casing pipe 1.

This accounts for an equilibrium of forces developed by the hydraulic shock waves and directed at the walls of the casing pipe 1. The above arrangement of the electrodes enables one to drive the casing pipe 1 strictly in the desired direction.

When the afore-mentioned body of revolution is a cylinder, the lines of action of electric discharges between the electrodes 12 and the ring electrode 11 are parallel to the axis of the casing pipe 1. As a result, hydraulic shock waves are produced both in the axial and radial directions with respect to the casing pipe 1, whereby a cavity may be produced in the ground around the casing pipe 1. Such a cavity helps to accelerate the progress of the casing pipe; it is also necessary in cases when piles with thicker portions have to be produced or when the casing pipe has to be inserted in a reinforcing cage.

Figure 5:
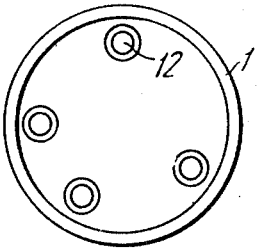
FIG. 5 is a plan view of an embodiment of the invention shown in FIG. 4 with a non-uniform circumferential spacing of the positive electrodes.

The circumferential spacing of the positive electrodes 12 above the negative ring electrode 11 may be uniform (FIG. 4) of non-uniform (FIG. 5). The non-uniform spacing is used to produce piles with a ribbed surface or piles having portions of an increased diameter, which are eccentric in relation to the pile axis.

Figure 6:
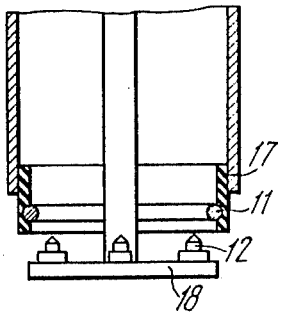
FIG. 6 is a fragmentary, side elevational view of the lower portion of the casing pipe in an embodiment of the invention where the positive electrodes are arranged under the negative ring electrode.

Other ways of arranging the electrodes 12 in relation to the ring electrode 11 are also possible. For example, the electrodes 12 may be arranged under the ring electrode 11 as shown in FIG. 6. In this case, the ring electrode 11 is secured inside the casing pipe 1 on an electrically insulating spacer 17, whereas the electrodes 12 are supported by a ring-type electrode holder 18 arranged below the level of the electrode 11.

Figure 7:
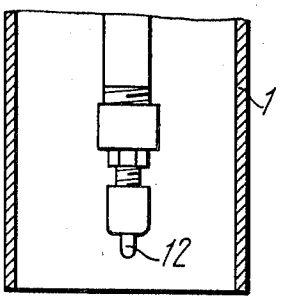
FIG. 7 is a fragmentary, side elevational view of the lower portion of the casing pipe in an embodiment of the invention where the function of the ring electrode is performed by the casing pipe.

FIG. 7 presents a simplified design wherein the casing pipe 1 itself is used to perform the function of the ring electrode of FIGS. 2, 3 and 6. Naturally, in this case the casing pipe 1 is manufactured from a conducting material.

According to FIG. 7, the installation features a single positive electrode 12 arranged coaxially with the casing pipe 1. Of course, the casing pipe 1 may accommodate a plurality of positive electrodes 12 spaced, for example, on the generatrices of a cylinder coaxial with the casing pipe 1, as shown in FIGS. 3 and 4.

The line of action of electric discharges can be made parallel to the axis of the casing pipe 1 by using combinations of shapes and arrangements of the electrodes other than those shown in FIGS. 3, 4 and 5.

For example, the installation may feature one or more pairs of electrodes with the electrodes of each pair arranged one above the other. According to FIG. 8, the positive electrode 12 and the negative electrode 11 are mounted coaxially with the casing pipe 1 on an electrode holder which is a pipe 19 rigidly secured to and concentric with the casing pipe 1.

The positive electrode 12 is installed in an insulating bush 20 and provided with a lead 21 for connection to the electric pulse generator 9 (FIG. 1). The insulating bush 20 (FIG. 8) is provided with a detachable cap 22 which is easily replaceable when worn out.

In order to mitigate the effects of abrupt dynamic load due to electric discharges on the casing pipe 1 and thus avoid its deformation, the pipe 19 carries a supporting spacer 23 and accommodates a shock-absorbing pad 24 interposed between the supporting spacer 23 and the insulating bush 20. The supporting spacer 23 must be wide enough to permit the flow of fluid to pass through the pipe 19 to the electrodes 11 and 12.

The negative electrode 11 is arranged under the positive electrode 12 and installed in a guide means 25 so that it is movable along the axis of the casing pipe 1. The guide means 25 is rigidly secured to the end portion of the pipe 19. The electrode 11 features two upward protrusions 26 with heads 27 which serve as stops for the movable electrode 11. One of the protrusions 26 is connected to a conductor 28 whereby the electrode 11 is connected to the electric pulse generator 9 (FIG. 1). Electric discharges make the movable electrode 11 (FIG. 8) vibrate along the axis of the casing pipe 1 so that it acts on the ground and thus accelerates the progress of the casing pipe 1.

The above arrangement is preferable, although the electrode 11 may, in principle, be rigidly secured to the pipe 19.

Figure 8:
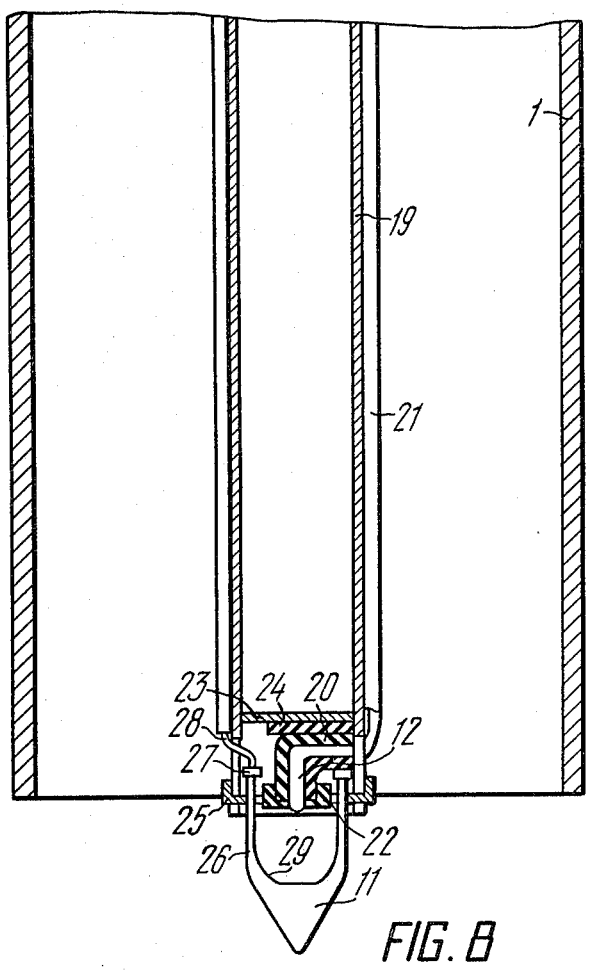
FIG. 8 is a detailed view in cross-section of the lower portion of the casing pipe in an embodiment of the invention, where the casing pipe accommodates a single pair of electrodes arranged one above the other.

FIG. 8 also shows the preferable shape of the electrode 11 which is tapered in the downward direction to facilitate the progress of the casing pipe 1.

A surface 29 of the negative electrode 11, which faces the positive electrode 12, is concave and serves to focus and localize hydraulic shock waves.

According to other construction of the electrodes, for example, those of FIGS. 3 through 6, the functions of the tapered portion and concave surface of the electrode 11 are performed by other elements of the casing pipe 1.

Figure 9:
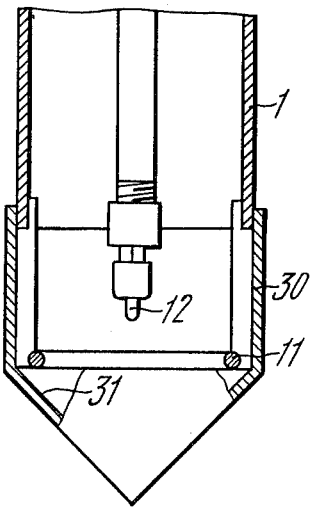
FIG. 9 is a fragmentary, side elevational view of the lower portion of the casing pipe in an embodiment of the invention, where a shoe is fitted over the lower end of the casing pipe.

According to FIG. 9, these functions are performed by a shoe 30 fitted over the lower end of the casing pipe 1.

The shoe 30 does not prevent hydraulic shock waves from hitting the ground; at the same time it facilitates the progress of the casing pipe 1 and impedes the ingress of soil particles into the pipe 1.

The internal surface 31 of the shoe 30 is concave. It may also be cone-shaped as shown in FIG. 9, in which case it serves to deflect shock waves in the radial direction with respect to the axis of the casing pipe 1.

There may be different versions of an installation according to the invention, featuring a single pair of electrodes arranged one above the other, apart from the embodiment of the invention, shown of FIG. 8. For example, both electrodes may be of the ring type or both may be shaped as rods.

Figure 10:
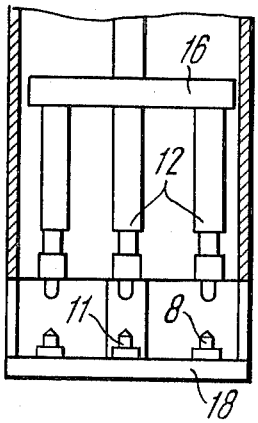
FIG. 10 is a fragmentary, side elevational view of the lower portion of the casing pipe in an embodiment of the invention, where the casing pipe accommodates several pairs of electrodes arranged one above the other.

The modification of the installation shown in FIG. 10 features a plurality of negative electrodes 11 and positive electrodes 12 which are all rods arranged one above another. The electrodes 11 are supported by the electrode holder 18, whereas the electrodes 12 are supported by the electrode holder 16 and spaced along a circumference which is concentric with the casing pipe 1. The pairs of electrodes may be spaced either equidistantly or non-uniformly along that circumference, as shown in FIGS. 4 and 5, respectively. The latter arrangement of the electrodes enables one to produce piles featuring thicker portions that are concentric in relation to the pile axis.

It is to be understood that apart from the electrode arrangements described above and illustrated in FIGS. 2 through 10, various other arrangements may be resorted to without departing from the scope of the present invention, provided, that they make it possible to initiate electric discharges and thus produce hydraulic shock waves of a desired power at the lower portion of the casing pipe 1.

FIGS. 11 through 18 illustrate preferred modifications of the method for producing cast-in-situ piles, carried out with the use of the installation described above.

Essentially, the method of the invention is realized as follows. First, consider the case when the electrodes 11 and 12 are arranged in the lower portion of the casing pipe 1 as shown in FIG. 1 and 8. The casing pipe 1 is set vertically or at a prescribed angle to the vertical at a desired point on the ground with the aid of the pile puller 2 (FIG. 1). The ground surface is thus the bottom of the casing pipe 1 and confines its internal volume. The pipe 1 is in the position shown in FIG. 11*a*. The fluid feed system 6 (FIG. 1) is then brought into play and through the pipeline 7 continuously feeds a fluid, such as water, into the casing pipe 1 in an amount sufficient to keep the spacing between the electrodes 11 and 12 (FIG. 8) always filled. The electric pulse generator 9 (FIG. 1) is put into action, and electric discharges are produced in the liquid medium. An electrohydraulic effect results at the lower portion of the casing pipe 1. The hydraulic shock waves compress the ground in the axial and radial directions, producing cavities under and around the casing pipe 1.

Thus, the casing pipe 1 goes down under gravity and as it does so, hydraulic shock waves, produced by new electric discharges, continue to compress the ground under and around the casing pipe 1.

Preferably, the fluid, wherein the electric discharges are produced, must possess the properties of a binder; thus the process of making a pile is accompanied by impregnating the surrounding soil with a binder, which makes it possible to build pile foundations in loose soils and slide-hazardous slopes. The binder may be any soil stabilizing agent, such as water glass, bentonite-silicate mortar or clay-cement mortar.

Figures 11A, 11B, 11C, 11D, 11E:
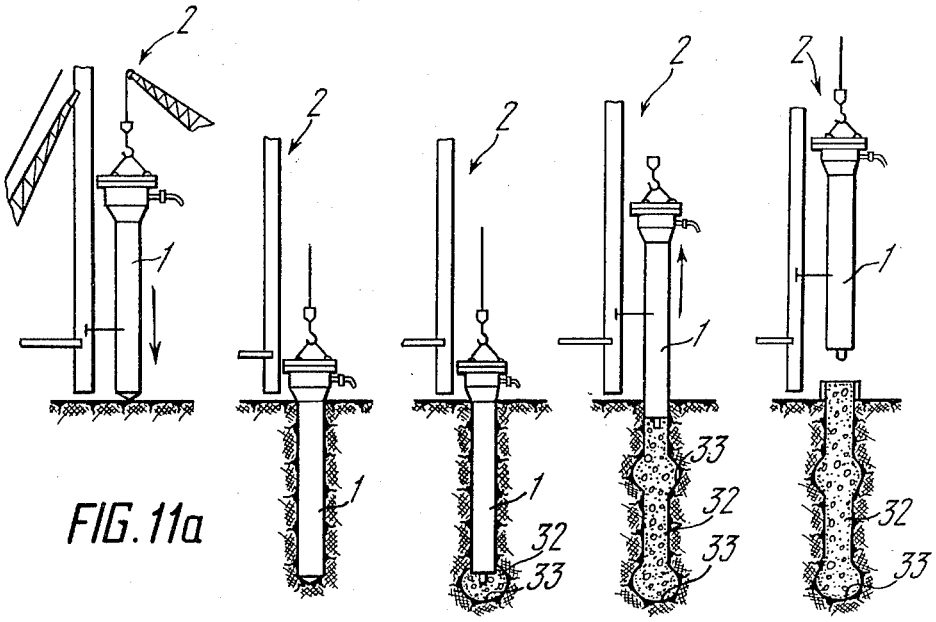
FIG. 11 *a, b, c, d, e* is a step-by-step representation of the process of producing a cast-in-situ pile in accordance with the invention (the arrows indicate the direction of motion of the casing pipe)
Figure 12:
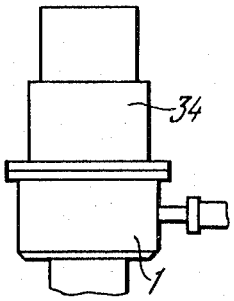
FIG. 12 is a fragmentary, side elevational view of the upper portion of the casing pipe in an embodiment of the invention, where a load is mounted on the upper butt end of the casing pipe.

As the casing pipe 1 is driven to a desired depth (FIG. 11*b*), the pile puller 2 starts to pull it out, and at the same time the concrete feeder 4 (FIG. 1) starts feeding concrete mix into the casing pipe 1. As a result, the hole made in the ground by the casing pipe 1 is gradually filled with the concrete mix 32 (FIG. 11*c*). The mix possesses the properties of a liquid medium and therefore has to be compacted; this is done by initiating electric discharges in the concrete mix through the use of the aforesaid technique.

The pulsating pressures exerted by electric discharges on the concrete mix are much greater than those produced by conventional vibrators, wherefore the compaction of the mix is considerably improved. This makes it possible to produce cast-in-situ piles of a high carrying capacity. The process also makes it possible to compact even very thick concrete mixes; this is an important advantage, keeping in mind that thick mixes account for a shorter hardening time.

Besides, the compaction of the concrete mix is carried out without discontinuing the pulling out of the casing pipe 1 as is the case with the known pile making methods. The result is a marked increase in productivity.

A pile with a widened base is made as follows. As the pile puller 2 starts pulling the casing pipe 1 from the ground, one increases the amount of energy released by electric discharges per unit of time and per unit of ground area in the zone covered by hydraulic shock waves to produce a cavity 33 of a desired size and shape (FIG. 11*c,d*).

The amount of energy released by the electric discharges is changed by varying the repetition frequency of the pulses generated by the electric pulse generator 9. One can also change the amount of energy carried by a single pulse, or the rate at which the casing pipe 1 is pulled from the ground. The above parameters may be varied separately or in any desired combination.

Depending on the sizes of piles to be made, the required production rate and properties of the soil and of the concrete mix, the foregoing parameters are varied within the following limits:

pulse repetition frequency, from 0.1 to 10 Hz;
amount of energy carried by
single pulse, from 0.1 to 300 kj;
pipe extraction rate, from 0.1 to 5 m/min.

The selection of the lower limit of any of the foregoing parameters is determined by economic considerations; and the choice of the upper limit is meant to ensure good compaction of the ground and concrete mix, as well as reliable and economical operation of the mobile installation used to carry out the method of this invention. For example, an excessively high pulse repetition frequency accounts for an increased number of discharges whereby no hydraulic shock waves are produced, and thus it affects the compaction of the ground and concrete mix, to say nothing of an increased power input.

An excessive amount of energy carried by a single pulse accounts for a rapid wear of the electrodes and affects the reliability of the pile making installation. Besides, an increase in the amount of energy carried by a single pulse means an increase in the size of the electric generator, which, in turn, leads to an increased weight and size of the installation as a whole. An excessively high rate of pulling the casing pipe has an adverse effect upon the compaction of the ground and concrete mix, which, in turn, affects the strength characteristics of piles being made.

The cross-sectional shape of the widened portions of the piles is largely determined by the arrangement of the electrodes. Consider the case when use is made of a single pair of electrodes 11 and 12 arranged coaxially with the casing pipe 1 (FIGS. 2, 7, 8 and 9), or when use is made of several pairs of electrodes 11 and 12 equidistantly spaced on a circumference concentric with the casing pipe 1, as shown in FIG. 4. In this case, a widened portion of a pile is concentric with the casing pipe 1. With a non-uniform arrangement of the electrodes (FIG. 5), a widened portion of a pile is eccentric in relation to the axis of the casing pipe 1. Apart from other factors, the shape of the cavity 33 and the resultant shape of the pile base are determined by the shape of the surfaces 29 and 31 (FIGS. 8 and 9) which determines the spatial distribution of the energy of its hydraulic shock waves. In the embodiments of the invention shown in FIGS. 8 and 9, this energy is uniformly distributed in all directions from the axis of the casing pipe 1. Asymmetrical shapes of the surfaces 29 and 31 account for a non-uniform energy distribution.

A pile produced in accordance with the invention may feature a plurality of widened portions.

Thus, by varying process parameters and the shape and arrangement of the electrodes and deflector surfaces, one can produce piles of variable sections and of different shapes and sizes.

FIG. 11*e* shows the position of the casing pipe 1 at the final stage of the pile making process, when the pipe 1 is fully extracted from the hole which is filled with the concrete mix 32.

In order to accelerate the downward progress of the casing pipe 1, the effect of electric pulses is complemented with mechanical action directed essentially downwards. This purpose may be achieved by statically loading the casing pipe 1. According to the embodiment of the invention shown in FIG. 12, this is done by placing a load 34 on the upper butt end of the casing pipe 1.

Figure 13:
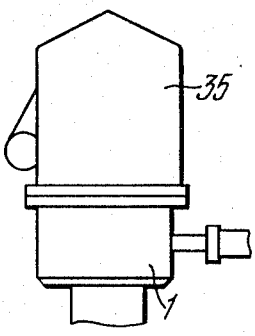
FIG. 13 is a fragmentary, elevational view of the upper portion of the casing pipe in an embodiment of the invention, where a vibrator is mounted on the upper butt end of the casing pipe.

According to the embodiment of the invention shown in FIG. 13, this purpose is achieved by using a conventional vibrator 35 mounted on the upper butt end of the casing pipe 1 and kinematically coupled to the pipe 1. Apart from its main function, the vibrator 35 also serves as the above-mentioned load 34.

Figure 14:
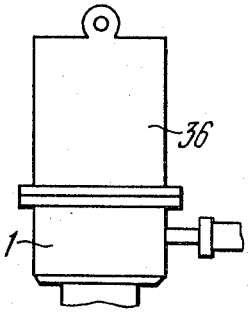
FIG. 14 is a fragmentary, side elevational view of the upper portion of the casing pipe in an embodiment of the invention, where a hammer is arranged above the upper butt end of the casing pipe.

According to an embodiment of the invention shown in FIG. 14, the casing pipe 1 is subjected to periodically recurring impact action. This is done with the aid of a hammer 36 (FIG. 14), such as a diesel-powered hammer.

Different types of mechanical action can be combined. For example, the casing pipe 1 may be simultaneously subjected to vibration action directed at a perpendicular to its axis and to impact action in the axial direction. This helps to accelerate the formation of a cavity under and around the casing pipe 1.

Figure 15:
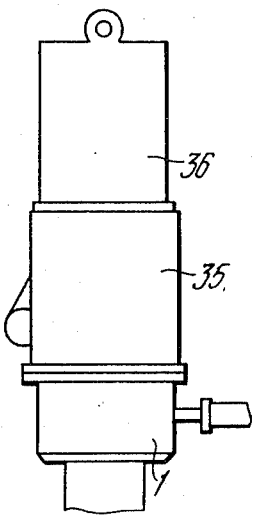
FIG. 15 is a fragmentary, side elevational view of the upper portion of the casing pipe in an embodiment of the invention, where a vibrator and hammer are used for joint mechanical action on the casing pipe.
Figure 16:
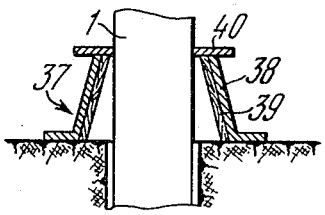
FIG. 16 is a cross-sectional view of a grillage sheathing used to carry out one of the preferred modifications of the method in accordance with the invention.

According to the embodiment of the invention shown in FIG. 15, the pile making installation includes the vibrator 35 mounted on the casing pipe 1, and the hammer 36 mounted on the vibrator 35.

It is to be pointed out that even without using any special means, the casing pipe 1 itself is responsible for some mechanical action on the ground, because it is made to vibrate by hydraulic shock waves.

The progress of the casing pipe 1 can be further accelerated by using a tapered cap at the lower end of the casing pipe 1.

In the embodiment of the invention shown in FIG. 8, the function of such a cap is performed by the electrode 11. In the embodiments of the invention shown in FIGS. 2, 3, 6, 7 and 10, this function is performed by the shoe 30 (FIG. 9) fitted over the lower end of the casing pipe 1 before it is driven into the ground. As the casing pipe 1 is pulled from the ground, the shoe 30 remains at the bottom of the hole under the column of the concrete mix 32.

In the case of laying raft-type foundations, the method of this invention is effected as follows. A sheathing 37 of a grillage foundation (FIG. 16) is assembled on the ground. It is of the conventional type and comprises a collapsible steel shuttering 38, a timber shuttering 39 and a means 40 for the removal of excessive concrete mix, which is arranged above the shutterings 38 and 39 and is pivotable in the horizontal plane.

The casing pipe 1 is passed through the sheathing and set on the ground. The operations of driving the casing pipe 1 into the ground, pulling it out, feeding concrete mix into the casing pipe 1 and compacting the concrete mix are carried out as described above. After the casing pipe 1 is pulled from the ground, the concrete mix is compacted by electric discharges produced in the sheathing 37, whereby the overground portion of the pile is made. The casing pipe 1 is then removed from the shuttering, and the means 40 removes the excessive mix.

When a pile of reinforced concrete has to be made, the method of this invention can be carried out in two ways (FIG. 17*a, b, c, d, e* and FIG. 18*a, b, c, d, e*).

A reinforcing cage 41 (FIGS. 17*a* and 18*a*), which serves to reinforce the pile to be made, is set on the ground, and the casing pipe 1 is either fitted over it (FIG. 17*b*) or inserted into it (FIG. 18*b*).

The casing pipe 1 and reinforcing cage 41 are then both driven to a desired depth as described above (FIGS. 17*c* and 18*c*).

The casing pipe 1 is then pulled from the ground. As this takes place, the concrete mix 32 is fed into the casing pipe 1 and compacted (FIGS. 17*d* and 18*d*). The concrete mix 32 keeps the reinforcing cage 41 on the bottom of the hole.

FIGS. 17*e* and 18*e* illustrate the final stage of the process, when the casing pipe 1 is fully pulled from the ground, and the hole, accommodating the reinforcing cage 41, is filled with concrete mix.

The version of FIG. 17 is preferable when working on soils so loose that the walls of a hole may collapse or tumble. The version of FIG. 18 is recommended for solid ground.

Like concrete piles, those of reinforced concrete may be provided with any number of broadening portions.

The advantages of the present invention will be better appreciated from a consideration of the following examples illustrating the process of making filling piles.

EXAMPLE 1

A casing pipe (FIG. 1) 300 mm in diameter is vertically driven into sandy ground to a depth of 5 m. Two electrodes 11 and 12 are arranged one above the other at the lower portion of the casing pipe as shown in FIG. 8.

The surface of the electrode 11, which faces the electrode 12, is concave; as a result, one half of the energy of the hydraulic shock waves is distributed in a horizontal plane to move the ground off the walls of the casing pipe, whereas the other half is directed downwards so as to drive the casing pipe into the ground. The distance between the electrodes is 50 mm.

After the casing pipe 1 (FIG. 1) is set on the ground, it is filled with a 6 l of water. Electric pulses are passed through the water to produce electric discharges therein. The electric parameters of the process are as follows:

current source voltage, 50 kV;
pulse repetition frequency, 2 Hz;
energy of a single pulse, 20 kj.

As the casing pipe goes down, water is continuously fed thereinto under a pressure of 10 kg/cm$^2$ and at a flow rate of 8 l/min.

It takes 3.5 minutes to reach the estimated depth of 5 m. Thus, the speed at which the casing pipe goes into the ground is 1.42 m/min, which is 250 percent higher than the speed attainable with the use of the conventional cast-in-situ pile making techniques.

Upon reaching the estimated depth, the supply of water is discontinued, and a concrete mix is fed into the casing pipe at a flow rate of 0.11 m$^3$/min. The percentage composition of the mix is as follows:

cement, 16
sand, 23.4
crushed stone, 53.4
water, 7.2.

The feeding of the concrete mix into the casing pipe 1 is accompanied by pulling the latter from the ground and producing electric discharges in the mix (the electric parameters of the process are mentioned above).

As a result, there is produced a concrete pile which is 5 m long and 300 mm in diameter. The compaction of the concrete mix is quite good, considering that the ultimate strength of the concrete is 270 kg/cm$^2$, whereas that of piles produced with the use of conventional techniques is never in excess of 135 kg/cm$^2$. The entire pile making process takes 8 minutes, as compared to 16.8 minutes required by the method according to USSR Inventor's Certificate No. 253,666, which is described above.

EXAMPLE 2

A casing pipe with dimensions as in Example 1 is driven to the same depth. The vibrator 35 (FIG. 13) is mounted in this case on the upper butt end of the casing pipe 1, and operates at a frequency of 420 Hz. It takes 2.2 min for the casing pipe to reach the estimated depth of 5 m.

Thus, the casing pipe is driven at a rate of 2.25 m/min It is pulled out as in Example 1.

The total duration of the pile making process is 6.7 min.

EXAMPLE 3

A casing pipe with dimensions as in Example 1 is fitted over the reinforcing cage 41 (FIG. 17*a, b, c, d, e*) which is composed of six steel rods 30 mm in diameter, linked together by steel wire 8 mm in diameter, welded to said rods. The pile is made as described in Example 1.

The process takes 9 minutes, including the time it takes to fit the casing pipe over the reinforcing cage.

EXAMPLE 4

A casing pipe with dimensions as in Example 1 is driven into the ground as described in Example 1. While the casing pipe is being pulled from the ground, 20 discharges are produced at the estimated depth of 5 m. The pulse repetion frequency is 2 Hz, and the single pulse energy is 30 kj. As a result, a base 750 mm in diameter is produced at the lower end of the pile (FIG. 11*c*). During further lifting of the casing pipe the single pulse energy is 20 kj.

1.36 min after the start of the extraction, i.e. at a moment the pipe is lifted 1.5 m above the 5-meter point, 20 discharges are produced over a period of 10 seconds with a single pulse energy increased to 30 kj.

As a result, a second expanded portion 750 mm in diameter (FIG. 11*d*) is produced on the pile. The single pulse energy is then again reduced to 20 kj, and the process is continued as in Example 1.

It takes 8 minutes to complete the pile. Due to the expanded portions, the carrying capacity of the pile is 200 percent higher than that of the pile produced as described in Example 1. It is worth remembering in this connection that conventional methods only make it possible to produce minor swellings on piles, whereby the carrying capacity of a pile is never increased by more than 6 percent.

EXAMPLE 5

A casing pipe with dimensions as in Example 1 is driven down as described in Example 1. As the pipe starts being lifted from the depth of 5 m, the pulse repetition frequency is maintained at the level of 10 Hz over a period of 10 seconds so that a base 750 mm in diameter (FIG. 11*c*) is produced at the lower portion of the pile. While the pile continues its ascent (as described in Example 1), the pulse repetition frequency is kept at the level of 2 Hz.

After 1.36 min following the start of the extraction, when the pipe is 1.5 m above the 5-meter point, the pulse repetition frequency is again raised to 10 Hz and thus maintained during 10 seconds. As a result, a second expanded portion 750 mm in diameter (FIG. 11*d*) is produced. The pulse repetition frequency is again brought down to 2 Hz, and the casing pipe is pulled out as in Example 1.

The process takes 8 min.

EXAMPLE 6

A casing pipe like the one of Example 1 is driven down as described in Example 1. The extraction of the casing pipe from the ground is started at a rate of 0.5 m/min, the electrical parameters of the process being as those of Example 1. The rate of 0.5 m/min is maintained during 15 sec, whereupon it is increased to 1.1 m/min, and the pipe is pulled out as described in Exmple 1. As a result, a base 750 mm in diameter (FIG. 11*c*) is produced at the lower end of the pile.

1.4 minute after the start of the extraction, when the pipe is 1.5 m above the bottom of the hole, the pulling rate is again reduced to 0.5 m/min and thus maintained during 15 sec. As a result, a second expanded portion 750 mm in diameter (FIG. 11*d*) is produced on the pile.

The rate of extraction is again raised to 1.1 m/min, and the process continues as described in Example 1.

It takes 8.5 min to complete the pile.

EXAMPLE 7

A casing pipe like the one of Example 1 is driven into the ground as in Example 1. The pulling out is started at a rate of 0.9 m/min; the single pulse energy is 25 kj, while the other electrical parameters are as those of Example 1. The pulling out thus proceeds during 10 sec. As a result, a base 750 mm in diameter (FIG. 11*c*) is produced at the lower portion of the pile.

The extraction of the pipe from the ground then proceeds at a rate of 1.1 m/min, while the single pulse energy is reduced to 20 kj; the extraction continues as in Example 1.

1.39 min after the start of the casing pipe extraction, when the pipe is 1.5 m above the bottom of the 5-meter hole, the extraction rate is again reduced to 0.9 m/min, while the single pulse energy is increased to 25 kj; the process is thus continued for 10 sec. As a result, a second expanded portion 750 mm in diameter (FIG. 11*d*) is produced on the pile.

The pipe extraction rate is then again brought to 1.1 m/min, while the single pulse energy is reduced to 20 kj, and the process is completed as in Example 1.

The making of the pile takes 8.2 min.

EXAMPLE 8

A casing pipe like the one of Example 1 is driven into the ground as described in Example 1. During the first 8 seconds of the pulling-out stage, the single pulse energy is 25 kj, and the pulse repetition frequency is 5 Hz; the other process parameters are the same as those of Example 1. Thus, a base 750 mm in diameter (FIG. 11*c*) is produced at the lower portion of the pile. The single pulse energy is then reduced to 20 kj, and the pulse repetition frequency is brought down to 2 Hz; the process continues as in Example 1.

1.36 min after the start of the extraction, when the pipe is 1.5 m above the bottom of the hole, the single pulse energy is again increased to 25 kj, and the pulse repetition frequency is raised to 5 Hz, which parameters are maintained during 8 sec. As a result, a second expanded portion 750 mm in diameter (FIG. 11*d*) is produced in the pile.

The single pulse energy is then again reduced to 20 kj, and the pulse repetition frequency is brought down to 2 Hz, whereupon the process is completed as described in Example 1.

It takes 8 min to make the pile.

EXAMPLE 9

A casing pipe like the one of Example 1 is driven into the ground as described in Example 1. During the first 11 seconds of the pulling-out stage, the extraction rate is 0.9 m/min, and the pulse repetition frequency is 7 Hz; the other process parameters are as those of Example 1. As a result, a base 750 mm in diameter (FIG. 11*c*) is produced at the lower end of the pile.

The rate of extraction of the casing pipe from the ground is then increased to 1.1 m/min, while the pulse repetition frequency is reduced to 2 Hz, whereupon the pulling out of the pipe is continued as described in Example 1.

1.38 sec after the start of the pipe extraction, when the pipe is 1.5 m above the bottom of the hole, the pipe extraction rate is again reduced to 0.9 m/min, whereas the pulse repetition frequency is increased to 7 Hz. Thus, the lifting of the pipe is continued for another 10 sec. As a result, a second expanded portion 750 mm in diameter (FIG. 11*d*) is produced on the pile.

After this, the casing pipe is again pulled out at a rate of 1.1 m/min, while the pulse repetition frequency is reduced to 2 Hz. The process is thus completed as described in Example 1.

It takes 8.2 min to make the pile.

EXAMPLE 10

A casing pipe like the one of Example 1 is inserted in a reinforcing cage (FIG. 18 *a, b, c, d, e*) composed of six steel rods 30 mm in diameter, linked together by wire 8 mm in diameter, welded to said rods.

The pipe is then set on dense clay soil, and the pile making process is carried out as described in Example 1.

It takes the casing pipe 3.9 min to reach the estimated depth of 5 m. The duration of the pile making process is 9.4 min, including the time required to insert the casing pipe in the reinforcing cage.

While particular embodiments of the present invention have been shown and described, various modifications thereof will be apparent to those skilled in the art and therefore it is not intended that the invention should be limited to the disclosed embodiments or to the details thereof; on the contrary, departures may be made therefrom, provided they are within the scope of the invention as defined in the appended claims.

What is claimed is:

1. A method for producing cast-in-situ piles, comprising setting a casing pipe on the ground, feeding a fluid into the casing pipe, passing electric pulses through the fluid to produce electric discharges having parameters such that permit hydraulic shock waves to be formed at the lower portion of said casing pipe, acting on the ground and on said casing pipe so as to drive the latter into the ground to a prescribed depth, whereafter the casing pipe is pulled from the ground as concrete mix is concurrently fed into said casing pipe and electric discharges are produced in the concrete mix to compact it.

2. A method as claimed in claim 1, wherein the parameter used to produce hydraulic shock waves at the lower portion of said casing pipe is the amount of energy released by electric discharges per unit of ground area covered by hydraulic shock waves, which amount of energy is varied to produce piles of variable sections.

3. A method as claimed in claim 2, wherein the amount of energy released by electric discharges per unit of time and per unit of ground area covered by hydraulic shock waves is varied by changing the pulse repetition frequency.

4. A method as claimed in claim 3, wherein the electric pulse repetition frequency is selected within the range of 0.1 to 10 Hz.

5. A method as claimed in claim 2, wherein the amount of energy released by electric discharges per unit of time and per unit of ground area covered by hydraulic shock waves is varied by changing the amount of energy carried by a single pulse.

6. A method as claimed in claim 5, wherein the amount of energy carried by a single pulse is selected within the range of 0.1 to 300 kj.

7. A method as claimed in claim 2, wherein the amount of energy released by electric discharges per unit of time and per unit of ground area covered by hydraulic shock waves is varied by changing the rate at which said casing pipe is pulled from the ground.

8. A method as claimed in claim 7, wherein the rate at which the casing pipe is pulled from the ground is selected in the range of 0.1 to 5 m/min.

9. A method as claimed in claim 2, wherein the amount of energy released by electric discharges per unit of time and per unit of ground area covered by hydraulic shock waves is varied by varying the pulse repetition frequency and the amount of energy carried by single pulses.

10. A method as claimed in claim 9, wherein the electric pulse repetition frequency is selected within the range of 0.1 to 10 Hz, and the amount of energy carried by a single pulse is selected within the range of 0.1 to 300 kj.

11. A method as claimed in claim 2, wherein the amount of energy released by electric discharges per unit of time and per unit of ground area covered by hydraulic shock waves is varied by varying the pulse repetition frequency and the rate at which said casing pipe is pulled from the ground.

12. A method as claimed in claim 11, wherein the electric pulse repetition frequency is selected within the range of 0.1 to 10 Hz, and the rate at which the casing pipe is pulled from the ground is selected within the range of 0.1 to 5 m/min.

13. A method as claimed in claim 2, wherein the amount of energy released by electric discharges per unit of time and per unit of ground area covered by hydraulic shock waves is varied by varying the amount of energy carried by single pulses and the rate at which said casing pipe is pulled from the ground.

14. A method as claimed in claim 13, wherein the amount of energy carried by a single pulse is selected within the range of 0.1 to 300 kj, and the rate at which the casing pipe is pulled from the ground is selected within the range of 0.1 to 5 m/min.

15. A method as claimed in claim 2, wherein the amount of energy released by electric discharges per unit of time and per unit of ground area covered by hydraulic shock waves is varied by varying the pulse repetition frequency, the amount of energy carried by single pulses and the rate at which said casing pipe is pulled from the ground.

16. A method as claimed in claim 15, wherein the electric pulse repetition frequency is selected within the range of 0.1 to 10 Hz, the amount of energy carried by a single pulse is selected within the range of 0.1 to 300 kj, and the rate at which the casing pipe is pulled from the ground is selected within the range of 0.1 to 5 m/min.

17. A method as claimed in claim 2, wherein a grillage sheathing is assembled on the ground prior to setting said casing pipe on the ground so that after said casing pipe is pulled from the ground, electric discharges intended to compact the concrete mix are produced in said grillage sheathing, whereby the overground portion of the pile is formed.

18. A method as claimed in claim 2, wherein the fluid, in which electric discharges are produced, possesses the properties of a binder.

19. A method as claimed in claim 2, wherein said casing pipe is subjected to mechanical action as it is driven into the ground by electrical discharges.

20. A method as claimed in claim 1, wherein the feeding of fluid into said casing pipe is preceded by fitting said casing pipe over a reinforcing cage which serves to reinforce the pile being made.

21. A method as claimed in claim 1, wherein the feeding of fluid into said casing pipe is preceded by inserting said casing pipe into a reinforcing cage which serves to reinforce the pile being made.

22. A method as claimed in claim 1, wherein a grillage sheathing is assembled on the ground prior to setting said casing pipe on the ground so that after said casing pipe is pulled from the ground, electric discharges intended to compact the concrete mix are produced in said grillage sheathing, whereby the overground portion of the pile is formed.

23. A method as claimed in claim 1, wherein the fluid, in which electric discharges are produced, possesses the properties of a binder.

24. A method as claimed in claim 1, wherein said casing pipe is subjected to mechanical action as it is driven into the ground by electrical discharges.

25. A method for producing cast-in-situ piles, comprising assembling grillage sheathing on the ground, setting a casing pipe on the ground therein, feeding a fluid possessing the properties of a binder into said casing pipe, and passing electric pulses through said fluid to produce electric discharges releasing energy resulting in hydraulic shock waves induced at the lower portion of said casing pipe and acting on the ground and on said casing pipe so as to drive said casing pipe into the ground being impregnated with the binder, and wherein the amount of energy released by electric discharges per unit of time and per unit of ground area covered by hydraulic shock waves is varied so as to produce a pile of a variable cross-section, and after driving the casing pipe to a prescribed depth, it is pulled out from the ground as concrete mix is concurrently fed into said casing pipe and electrical discharges are produced in said concrete mix so as to compact it and thereby form the underground portion of the pile, and on pulling said casing pipe from the ground, electric discharges for compacting the concrete mix are produced in said grillage sheathing to thereby form the overground portion of the pile being produced.

26. A method as claimed in claim 25, wherein the feeding of fluid into said casing pipe is preceded by fitting said casing pipe over a reinforcing cage which serves to reinforce the pile being made.

27. A method as claimed in claim 25, wherein the feeding of fluid into said casing pipe is preceded by inserting said casing pipe in a reinforcing cage which serves to reinforce the pile being made.

28. A method as claimed in claim 25, wherein said casing pipe is subjected to mechanical action as it is driven into the ground by electric discharges.

29. An installation for producing cast-in-situ piles, comprising:

a casing pipe having an upper butt end and a lower butt end;

a pile puller coupled to said casing pipe and intended to set said casing pipe on the ground, support it and pull it from the ground;

a pile driver coupled to said casing pipe and comprising:

a fluid feed system communicating with said casing pipe;

a pulse device comprising: electrodes installed in said casing pipe close to its lower butt end;

an electric pulse generator arranged in proximity to said casing pipe, electrically connected to said electrodes and intended to generate electric pulses to produce electric discharges between said electrodes, whereby hydraulic shock waves are formed in the fluid fed into said casing pipe, which act on the ground and on said casing pipe and drive said casing pipe into the ground;

a concrete feeder operably coupled to said casing pipe and intended to feed concrete mix into said casing pipe as it is pulled from the ground.

30. An installation as claimed in claim 29, wherein at least one of said electrodes is a ring electrode arranged coaxially with said casing pipe.

31. An installation as claimed in claim 30, wherein the function of said ring electrode is performed by said casing pipe.

32. An installation as claimed in claim 29, wherein said electrodes are so arranged in said casing pipe that the lines of action of electric discharges between said electrodes are roughly parallel to the axis of said casing pipe.

33. An installation as claimed in claim 32, wherein said electrodes are grouped into at least one pair, the electrodes of each pair being arranged one above the other.

34. An installation as claimed in claim 33, wherein the lower of said pair of electrodes is tapered in the downward direction.

35. An installation as claimed in claim 34, wherein the lower electrode of said pair of electrodes is movable along the axis of said casing pipe so that electric discharges make this electrode vibrate and thus act on the ground.

36. An installation as claimed in claim 35, wherein the surface of the lower electrode of said pair of electrodes, which faces the upper electrode, is concave and serves to focus and localize hydraulic shock waves.

37. An installation as claimed in claim 36, including a load mounted on said upper butt end of said casing pipe to provide a static loading on said casing pipe as it is driven into the ground.

38. An installation as claimed in claim 37, including a vibrator mounted on said upper butt end of said casing pipe to subject said casing pipe to vibratory action as it is driven into the ground.

39. An installation as claimed in claim 38, including a hammer arranged above said upper butt end of said casing pipe and intended to periodically strike said casing pipe as it is driven into the ground.

40. An installation as claimed in claim 37, including a hammer arranged above said upper butt end of said casing pipe and intended to periodically strike said casing pipe as it is driven into the ground.

41. An installation as claimed in claim 36, including a vibrator mounted on said upper butt end of said casing pipe to subject said casing pipe to vibratory action as it is driven into the ground.

42. An installation as claimed in claim 41, including a hammer arranged above said upper butt end of said casing pipe and intended to periodically strike said casing pipe as it is driven into the ground.

43. An installation as claimed in claim 36, including a hammer arranged above said upper butt end of said casing pipe and intended to periodically strike said casing pipe as it is driven into the ground.

44. An installation as claimed in claim 29, wherein one of said electrodes is a ring electrode coaxially arranged with said casing pipe, whereas all the other electrodes are rods arranged above said ring electrode and spaced on generatrices of a conventional body of revolution coaxial with said casing pipe so that the lines of action of electric discharges between said electrodes are roughly parallel to the axis of said casing pipe.

45. An installation as claimed in claim 29, wherein said pile driver is provided with at least one deflector coupled to said lower butt end of said casing pipe and intended to focus and localize hydraulic shock waves.

46. An installation as claimed in claim 29, including a load mounted on said upper butt end of said casing pipe to provide a static loading on said casing pipe as it is driven into the ground.

47. An installation as claimed in claim 29, including a vibrator mounted on said upper butt end of said casing pipe to subject the casing pipe to vibratory action as it is driven into the ground.

48. An installation as claimed in claim 29, including a hammer arranged above said upper butt end of said casing pipe and intended to periodically strike said casing pipe as it is driven into the ground.

* * * * *